US006977618B1

(12) United States Patent
Hanewinkel, III et al.

(10) Patent No.: US 6,977,618 B1
(45) Date of Patent: Dec. 20, 2005

(54) AIRCRAFT FOLDING ANTENNA ASSEMBLY

(75) Inventors: William H Hanewinkel, III, Salt Lake City, UT (US); Donald F Rockwell, Bountiful, UT (US); Timothy G Crowther, Farmington, UT (US)

(73) Assignee: L3 Communications Corporation, New York, NY (US)

( * ) Notice: Subject to any disclaimer, the term of this patent is extended or adjusted under 35 U.S.C. 154(b) by 172 days.

(21) Appl. No.: 10/729,462

(22) Filed: Dec. 5, 2003

(51) Int. Cl.[7] ..... H01Q 1/28
(52) U.S. Cl. ..... 343/705; 343/874
(58) Field of Search ..... 343/705, 708, 343/874

(56) References Cited

U.S. PATENT DOCUMENTS 2,275,626 A * 3/1942 Harrison ..... 52/110
2,502,650 A * 4/1950 Harris et al. ..... 244/1 TD
2,522,222 A * 9/1950 Haller ..... 343/872
3,656,160 A * 4/1972 Burton ..... 343/702
5,610,620 A * 3/1997 Stites et al. ..... 343/725
6,056,237 A * 5/2000 Woodland ..... 244/3.15
6,496,151 B1 * 12/2002 Ferreri et al. ..... 343/708
6,661,388 B2 * 12/2003 Desargant et al. ..... 343/766
6,831,610 B2 * 12/2004 Quagliaro ..... 343/705
6,844,855 B2 * 1/2005 Carson ..... 343/705

* cited by examiner

*Primary Examiner*—Shih-Chao Chen
(74) *Attorney, Agent, or Firm*—Harrington & Smith, LLP

(57) ABSTRACT

An aircraft radio antenna assembly including a mast; an omni-directional antenna connected to a first end of the mast; and a pivot and movable latch connection system at a second end of the mast. When the pivot and latch connection system is attached to an aircraft, the mast can be located at a stowed position or pivoted up to a deployed position and latched into the deployed position. The assembly can also include a break-away system to allow part of the antenna assembly to detach without significantly damaging the antenna assembly.

47 Claims, 9 Drawing Sheets

AIRCRAFT FOLDING ANTENNA ASSEMBLY

BACKGROUND OF THE INVENTION

1. Field of the Invention

The present invention relates to an aircraft antenna and, more particularly, to an antenna assembly which can be reconfigured between a stowed position and a deployed position.

2. Brief Description of Prior Developments

In some applications, a tall mast must be used to locate a radio antenna away from an aircraft structure so that the antenna pattern can reach its intended target and not be blocked or shadowed by parts of the aircraft. The known art of aircraft antennas utilizes a rigid mounting style to affix antennas to aircraft exteriors. Different methods are used and they can vary from using threaded fasteners through the antenna's base plate to integrating the mast as part of a composite aircraft skin. Small manned aircraft, as well as robotic or unmanned aircraft, are sometimes stored and/or transported in relatively small volume trailers or trucks.

There is a desire to provide an aircraft antenna which can be reconfigured between a stowed position and a deployed position. However, there is also a desire to minimize electrical signal losses through connections of the antenna to other electronic circuitry in the aircraft, and also allow the antenna to be moved to its deployed position and locked in its deployed position without the use of special tools.

SUMMARY OF THE INVENTION

In accordance with one aspect of the present invention, an aircraft radio antenna assembly is provided including a mast; an omni-directional antenna connected to a first end of the mast; and a pivot and movable latch connection system at a second end of the mast. When the pivot and latch connection system is attached to an aircraft, the mast can be located at a stowed position or pivoted up to a deployed position and latched into the deployed position.

In accordance with another aspect of the present invention, an aircraft radio antenna assembly is provided comprising an antenna; and a mast having the antenna connected to a first end of the mast. The mast comprises an aircraft mounting section located at a second end of the mast, a main section extending from the aircraft mounting section to the first end of the mast, and a breakaway connection between the main section and the aircraft mounting section.

In accordance with another aspect of the present invention, an aircraft antenna mast connection system is provided comprising a mast pivot bracket connected to an aircraft and a mast base. The mast pivot bracket comprises a base section attached to the aircraft and a pivot section forming a pivot axis at an extended distance from the base section. The mast base is pivotably connected to the mast pivot bracket at the extended distance from the base section. The mast base has a hole with an antenna cable passing from the aircraft and through the hole. Rotation of the mast base from a deployed position with the mast base being against the aircraft to a stowed position with the mast base being spaced away from the aircraft provides an enlarged radius of curvature for the antenna cable provided by the pivot axis being located at the extended distance from the base section. In a preferred embodiment, the extended distance is about 0.75 inches.

In accordance with another aspect of the present invention, an aircraft antenna mast connection system is provided comprising a mast pivot bracket connected to an aircraft; an aircraft mounting section of an antenna mast; and at least one movable latch. The aircraft mounting section comprises a mast base and at least one latch receiver. The mast base is pivotably connected to the mast pivot bracket at a first end of the mast base and the at least one latch receiver is attached to an opposite second end of the mast base. Then at least one movable latch is attached to the aircraft. The latch comprises a spring loaded plunger adapted to latch with at least one latch receiver when the aircraft mast is moved to a deployed position.

In accordance with one method of the present invention, a method of positioning an aircraft antenna mast at a deployed position is provided comprising steps of pivoting the aircraft antenna mast on a mast pivot bracket at a rear side of the mast from a stowed position to the deployed position; and moving a latch on the aircraft from an unlatched position to a latched position, wherein the latch is located along a lateral side of the mast and the latch has a latching plunger which moves forward when the latch is moved to the latched position to engage a latch receiver on a front side of the mast.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENT

Figure 1:
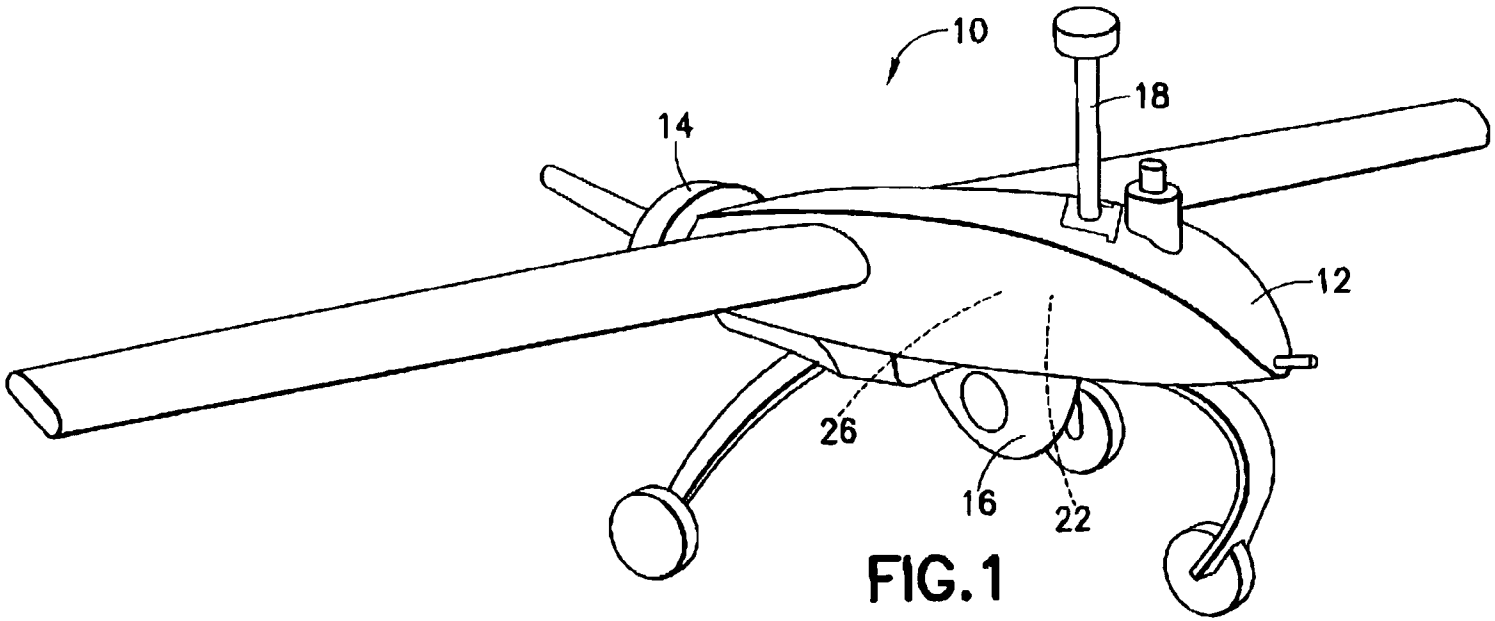
FIG. 1 is a perspective view of an aircraft incorporating features of the present invention with the antenna assembly located at a deployed position.

Referring to FIG. 1, there is shown a perspective view of an aircraft 10 incorporating features of the present invention. Although the present invention will be described with reference to the exemplary embodiment shown in the drawings, it should be understood that the present invention can be embodied in many alternate forms of embodiments. In addition, any suitable size, shape or type of elements or materials could be used.

The present invention is generally directed to a folding antenna mast for an aircraft. The purpose of the invention is to allow a radio antenna to fold down on an aircraft exterior, thus, making a lower profile for storing the aircraft and/or land transport of the aircraft within a limited storage volume. New features of the invention include a means of rigidly holding the mast in an upright position, a folding pivot mechanism, and a latch for holding the mast in a folded position for storage. Another feature of the mast is a mechanical fuse or weak link allowing the mast to break off in the event the mast is impacted; leaving more expensive components and the aircraft structure undamaged.

In the embodiment shown, the aircraft 10 is an unmanned aerial vehicle (UAV) which generally comprises an air frame 12, a drive 14, a viewing unit 16 and an antenna assembly 18. The air frame 12 is a fixed wing type of air frame. However, features of the present invention could alternatively be used in a non-fixed wing aircraft. The drive 14, in the embodiment shown, comprises a motor and a propeller. However, in alternate embodiments, any suitable type of drive could be used, such as a turbine engine. The viewing unit 16 includes an optical video camera, but could alternatively or additionally comprise an infrared video camera or any other suitable type of viewing device. The antenna assembly 18 is used to allow remote control of the aircraft and transmission of signals from the viewing unit 16 back to a remote viewing area. The antenna assembly 18 is shown in a deployed position in FIG. 1.

Figure 2:
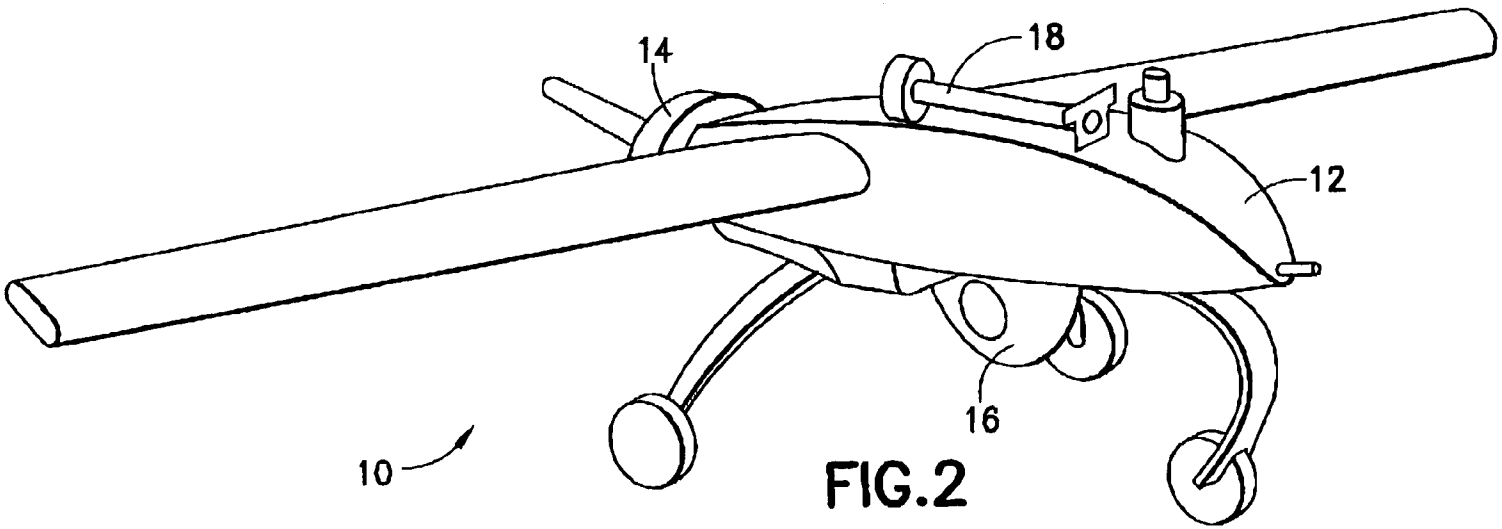
FIG. 2 is a perspective view of the aircraft shown in FIG. 1 with the antenna assembly moved to a stowed position.

Referring also to FIG. 2, the aircraft 10 is shown with the antenna assembly 18 moved to a stowed position. The wings of the aircraft can preferably be removed or collapsed into a stowed position to allow for storage or transport of the aircraft 10 in a more compact storage volume. As seen in comparing the aircraft shown in FIG. 1 versus the aircraft shown in FIG. 2, when the antenna assembly 18 is moved to the stowed position the vertical height of the aircraft is reduced.

Figure 3:
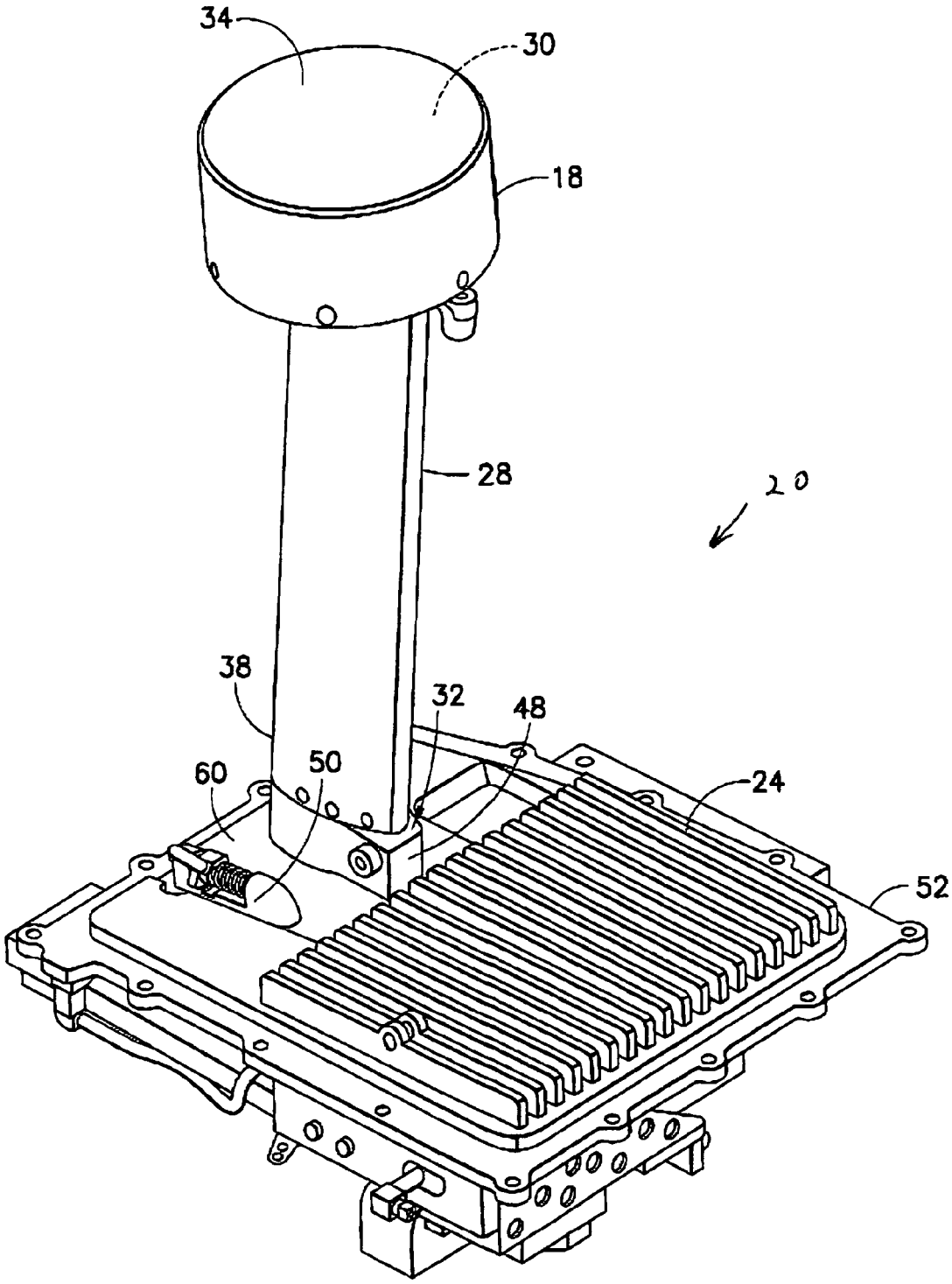
FIG. 3 is a perspective view of a portion of the airborne communications assembly used in the aircraft shown in FIG. 1 with the antenna assembly at the deployed position.
Figure 4:
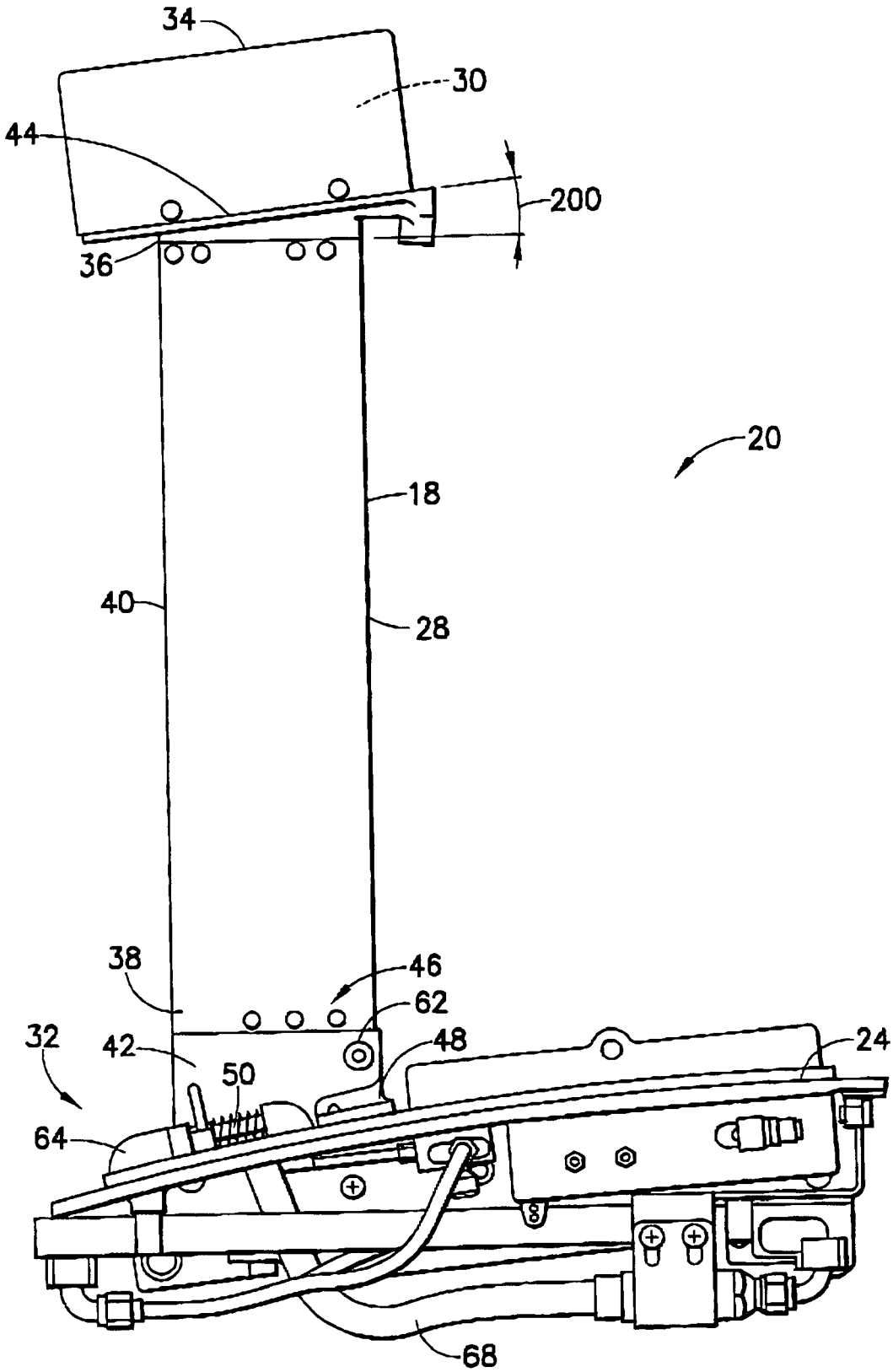
FIG. 4 is an elevational side view of the antenna assembly and end of the airborne communications assembly in a deployed position as shown in FIGS. 1 and 3.

Referring now to FIGS. 3–4, the antenna assembly 18 is shown as part of an airborne communications assembly 20. The communications assembly 20 uses radio frequency (RF) signals to communicate with a remote location. The communications assembly 20 generally comprises the antenna assembly 18, an airborne microwave modem assembly 22 (see FIG. 1), a remote front end 24 and an airborne link interface assembly 26 (see FIG. 1). The remote front end 24 receives Return Link RF signals from the airborne microwave modem assembly 22, amplifies and filters the signals, and sends the signals to the antenna in the antenna assembly 18. The remote front end 24 also receives the Control Link RF signals from the antenna, filters and amplifies the signals, and sends the signals to the airborne microwave modem assembly 22.

Figure 5:
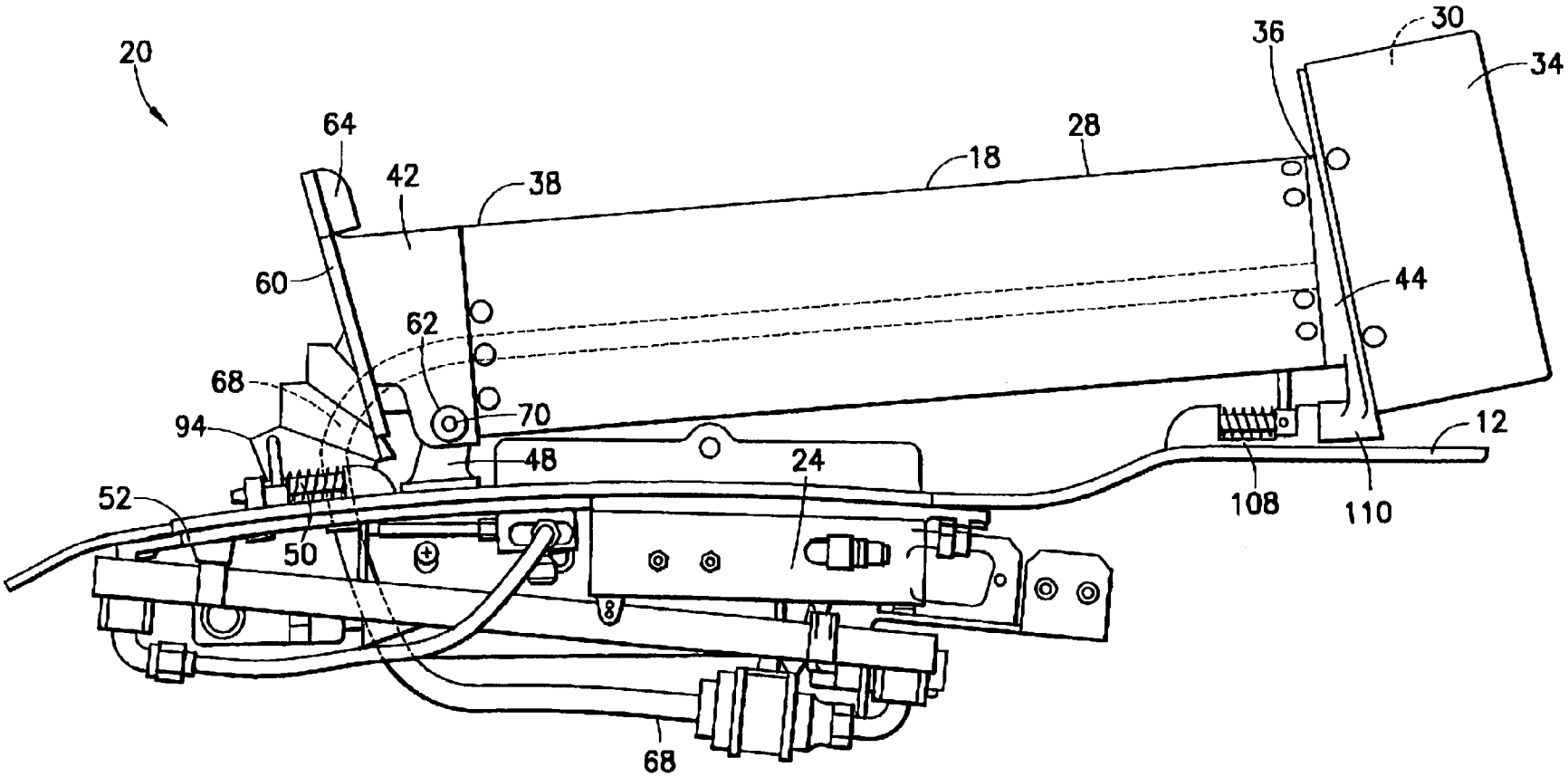
FIG. 5 is an elevational side view of the antenna assembly and the remote front end shown in FIG. 4 in a stowed position as shown in FIG. 2.
Figure 6:
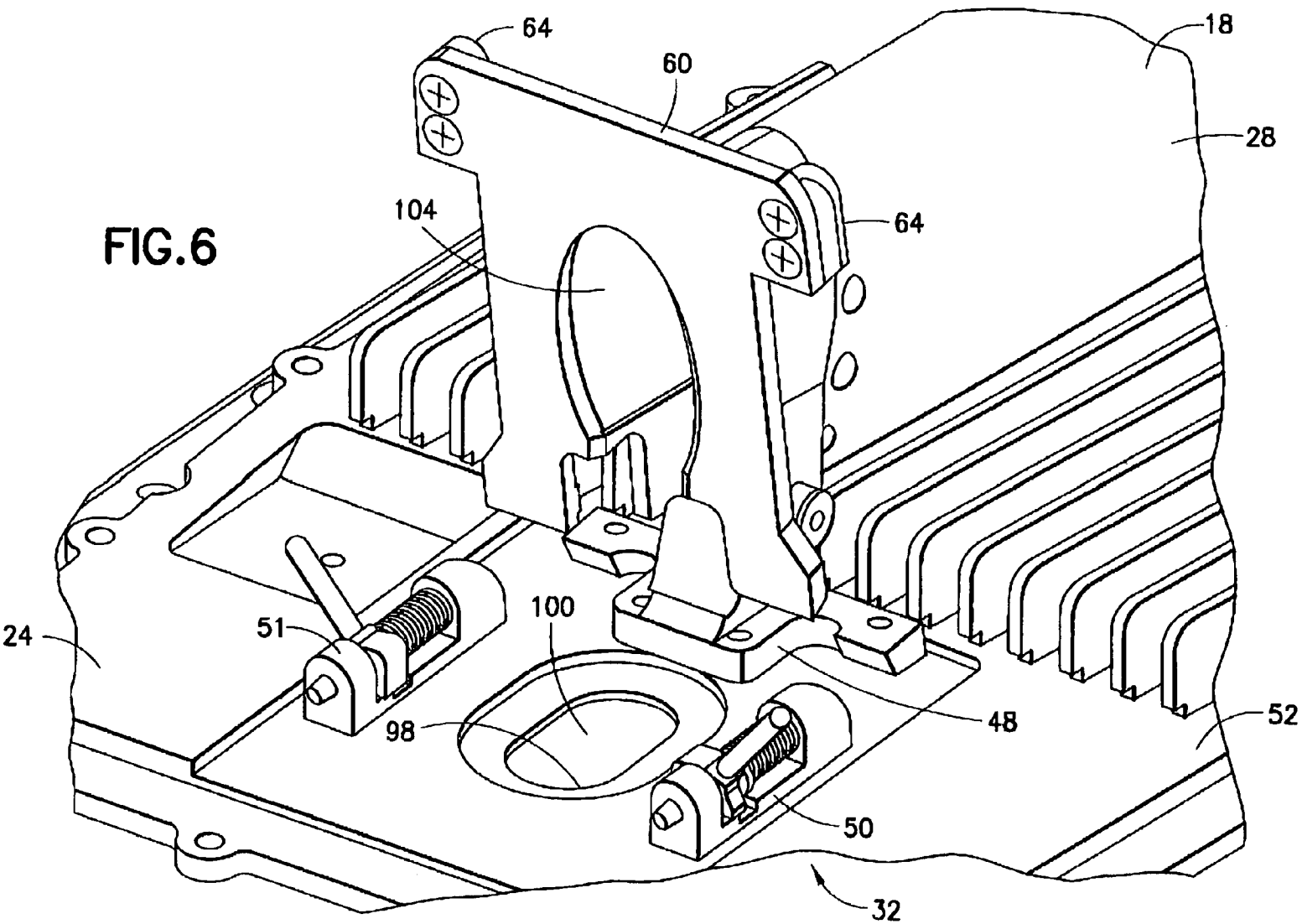
FIG. 6 is a partial perspective view of the antenna assembly at the remote front end shown in FIG. 5, but without showing the boot and antenna cable for the sake of clarity.

FIGS. 3 and 4 show the antenna assembly 18 at its deployed position. Referring also to FIGS. 5 and 6, the antenna assembly 18 is shown at its stowed position. FIG. 6 shows the antenna assembly without its boot 94 and the antenna cable 68 merely for the sake of clarity. The antenna assembly 18 generally comprises a mast 28, an antenna 30, and a pivot and movable latch connection system 32. The antenna 30 is preferably an omni-directional antenna. The antenna 30 is covered by a radome 34. The antenna 30 and radome 34 are connected to a first top end 36 of the mast 28. The opposite second bottom end 38 of the mast 28 is connected to the connection system 32.

Figure 7:
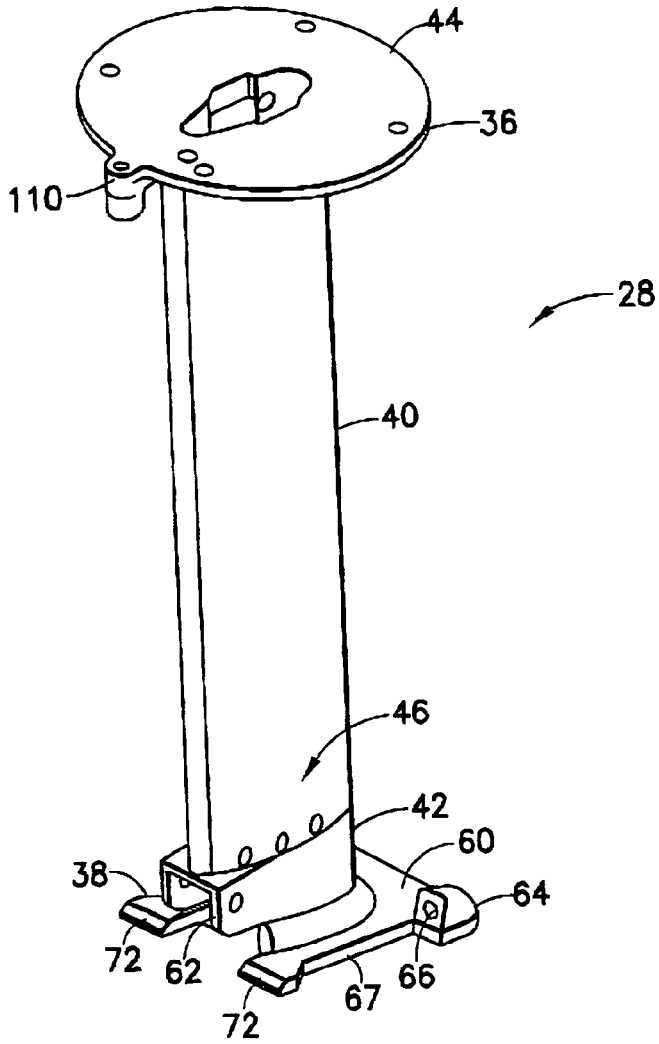
FIG. 7 is a perspective view of the mast used in the antenna assembly shown in FIG. 4.

Referring also to FIG. 7, the mast 18 comprises a main section 40, an aircraft mounting section 42, an antenna mounting section 44, and a breakaway connection 46. The main section 40 and aircraft mounting section 42 include aerodynamic shapes. The aircraft mounting section 42 forms part of the connection system 32.

The breakaway connection 46 is located between the main section 40 and the aircraft mounting section 42. In the embodiment shown, the breakaway connection 46 comprises rivets which connect the main section 40 to the aircraft mounting section 42. The rivets are comprised of material which is weaker than material which forms the main section 40 and the aircraft mounting section 42. For example, the main section 40 and aircraft mounting section 42 could be comprised of 6061 T6 aluminum and the rivets could be comprised of 2117 T4 aluminum. The rivets form fusible links. The geometric size (diameter) of the rivets can also help form the weak link. This provides a trade off of material and size (shear strength) and trying to provide adequate fatigue strength for the component's expected life. Thus, if excessive force is exerted against the mast 28 when the mast is in its deployed position, the rivets of the breakaway section 46 will break or shear off allowing the main section 40 to move relative to the aircraft mounting section 42. In the event of an impact to the mast 28 or radome 34, the breakaway section 46 can allow the main section 40 and radome 34 to breakaway; preventing more expensive components of the aircraft from sustaining damage. In an alternate embodiment, any suitable type of mechanical weak link or breakaway connection could be provided.

The breakaway feature has been found to be particularly useful with a UAV when the UAV must be recovered or caught in a catch net. If excessive force is exerted on the mast in the catch net, the mast can breakaway without damaging the rest of the aircraft. The breakaway connection can preferably be repaired or replaced relatively easily; such as in the field without having to be returned to the manufacturer or a centralized repair facility.

Figure 8:
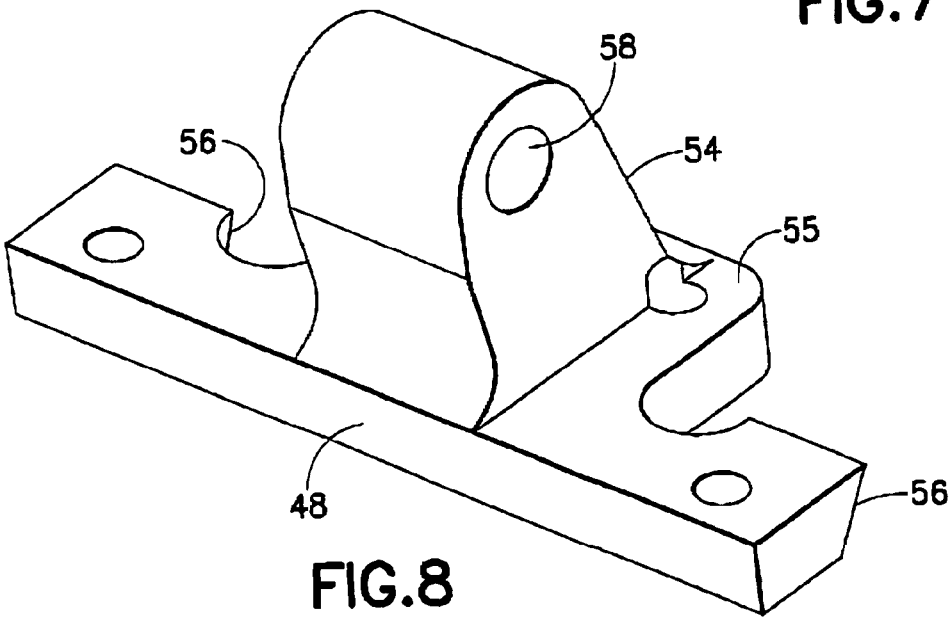
FIG. 8 is a perspective view of the mast pivot bracket used in the connection system of the antenna assembly shown in FIGS. 4 and 5.
Figure 9:
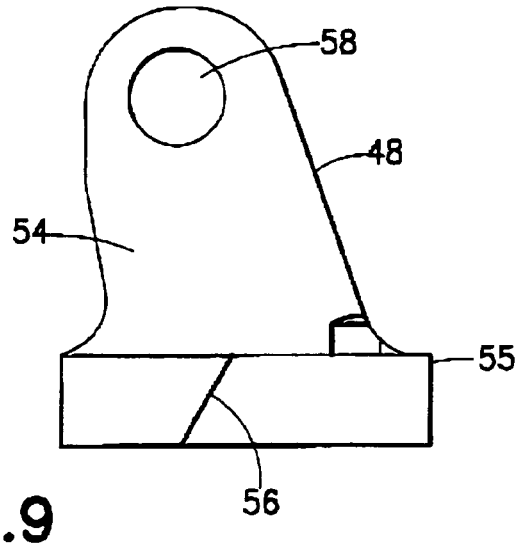
FIG. 9 is an elevational side view of the mast pivot bracket shown in FIG. 8.

Referring to FIG. 6, the connection system 32 generally comprises the aircraft mounting section 42, of the mast 28, a mast pivot bracket 48 and two movable latches 50, 51. The mast pivot bracket 48 is stationarily connected to the frame 52 of the remote front end 24. Referring also to FIGS. 8 and 9, the mast pivot bracket 48 comprises a center pivot section 54, a base section 55, and two rearward and downward beveled surfaces 56 at a front side of the base section on opposite sides of the pivot section. The center pivot section 54 comprises a pivot hole 58. The aircraft mounting section 42 is pivotably connected to the mast pivot bracket 48 at the pivot hole 58 by a suitable pivot, such as with a bronze bushing to prevent corrosion gauling and wear.

Referring back to FIG. 7, the aircraft mounting section 42 generally comprises a base section 60, a pivot section 62 at a rear end of the base section, and two latch receivers 64 located at a front end of the base section at opposite lateral sides of the base section. The pivot section 62 is pivotably connected to the pivot section 54 of the mast pivot bracket 48. Thus, the aircraft mounting section 42 can pivot on the mast pivot bracket 48 between the deployed position shown in FIG. 4 and a stowed position as shown in FIG. 5. The latch receivers 64 each comprise a rear end with a hole 66. The hole 66 is tapered to receive a tapered front end of a latch plunger. The base section 60 comprises lateral cutout sections 67 located behind the latch receivers 64. The cutout sections 67 are located on both lateral sides of the base section 60. The cutout sections 67 are provided to allow positioning of the latches 50 51 on opposite lateral sides of the base section 60 directly behind the latch receivers 64.

The pivot section 62 is located at an elevated distance from the base section 60. The pivot hole 58 in the pivot section 54 of the mast pivot bracket 48 is also located at an elevated distance from the base section 55. As seen in FIG. 5, because the pivot axis 70 of the two pivot sections 54, 62 is located at an elevated distance from the base sections 55, 60, rotation of the mast base from a deployed position (FIG. 4) to a stowed position (FIG. 5) provides an enlarged radius of curvature for the antenna cable 68. If the pivot axis 70 was closer to the aircraft, the curvature of the antenna cable 68 would be less and the travel of the cable 68 relative to frame 52 would be greater. However, the antenna cable is relatively stiff and, this might cause damage to the antenna cable. One solution could be to provide a longer antenna cable. However, overall cable length is preferably kept as short as possible to reduce the signal loss. Thus, the present invention allows the overall cable length to be kept short and eliminates possible damage to the relatively stiff antenna cable by providing a larger bend curvature. One of the features of the present invention is that the antenna cable 68 extends the entire distance from its two connection ends without any intermediate connections. Because intermediate disconnectable connections are not provided in the cable 68, this reduces signal loss in the cable, but the antenna assembly is still collapsible. In addition, by not having intermediate disconnectable connectors, reliability is improved.

Figure 15:
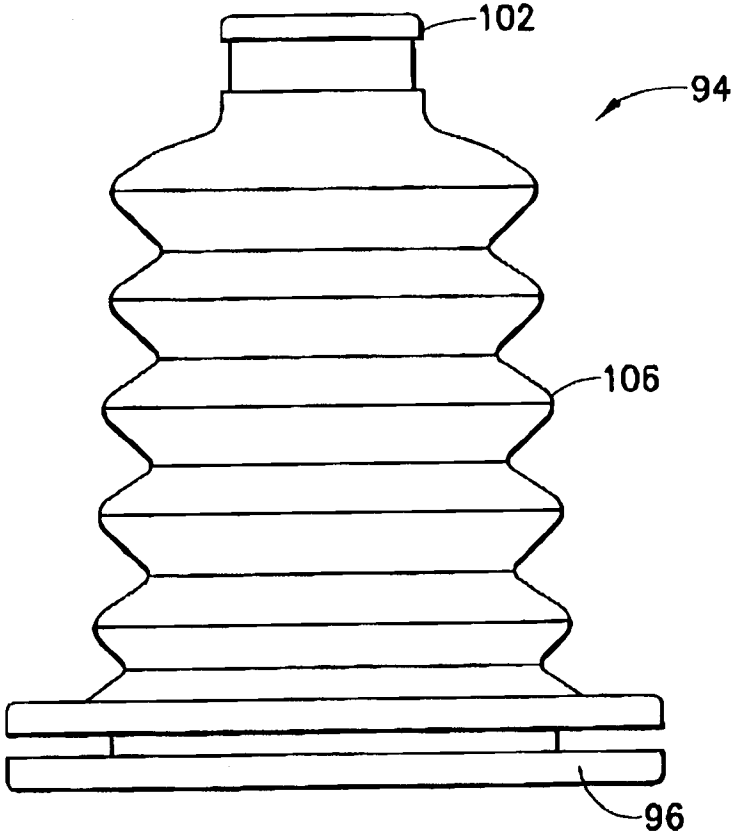
FIG. 15 is a front elevational view of the boot shown in FIG. 14.
Figure 14:
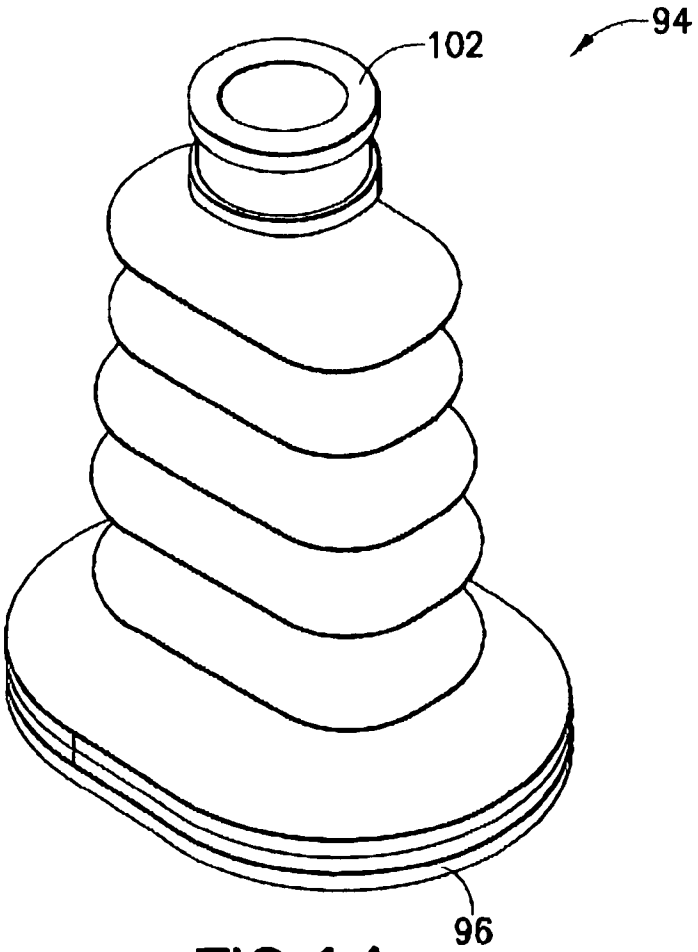
FIG. 14 is a perspective view of the boot used in the connection system shown in FIG. 5.

Referring also to FIGS. 14 and 15, the antenna assembly in the embodiment shown is provided with a boot 94. As seen in FIG. 5, the boot 94 is connected between the frame 52 of the remote front end 24 and the aircraft mounting section 42 of the mast 28. The boot 94 is a one-piece member comprised of molded polymer or rubber material which is resilient. The boot 94 has a first section 96 which is attached to the lip 98 (see FIG. 6) surrounding the hole 100 through the frame 52 of the remote front end 24. The boot 94 has an opposite second section 102 which is attached to the aircraft mounting section 42 inside a hole 104 through the aircraft mounting section 42. The boot 94 provides a path or conduit between the two holes 100, 104. The boot 94 has a center section 106 with a general accordion type of profile. The center section 106 can be collapsed and expanded in a general accordion type of movement. Thus, as illustrated in FIG. 5, regardless of the pivotal location of the aircraft mounting section 42 relative to the frame 52, the boot 94 can provide a sealed conduit between the mast 28 and the remote front end 24. The boot 94 prevents debris and the moisture from entering through the holes 100, 104 and causing potential problems with the electronics or air frame of the aircraft. However, in an alternate embodiment, the boot might not be provided or any suitable type of sealing structure could be provided.

Referring back to FIG. 7, the rear end of the pivot base 60 comprises two spaced sections with rearward facing surfaces 72. The surfaces 72 are inclined or angled in an upward and forward direction. When the aircraft mounting section 42 is moved to its deployed position, as shown in FIG. 4, the surfaces 72 contact the beveled surfaces 56 (see FIGS. 8 and 9) of the mast pivot bracket 48. The slopes or tapers of the surfaces 56, 72 allows the rear end of the base section 60 to be wedged downward towards the aircraft. This helps to locate the base section 60 at a stable and stationary location against the top surface of the frame 52 of the remote front end 24. The design is preferably as rigid as possible to avoid rotation about three axes when the antenna system is deployed.

Figure 10:
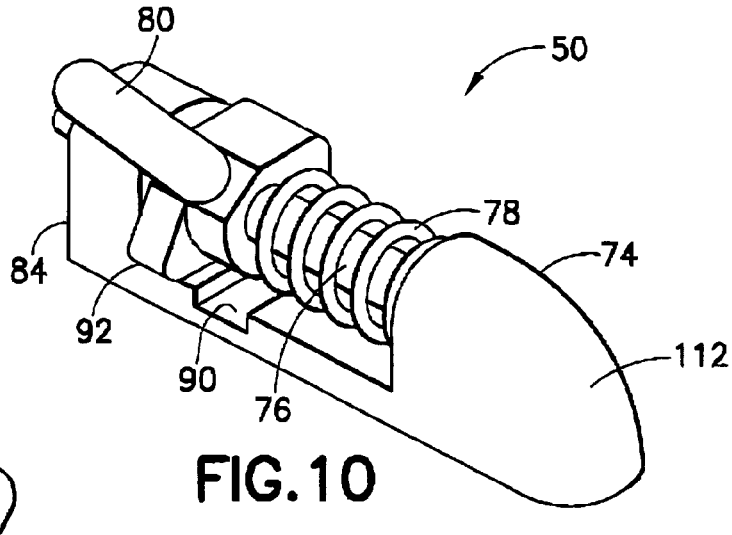
FIG. 10 is a perspective view of one of the movable latches used in the connection system.
Figure 11:
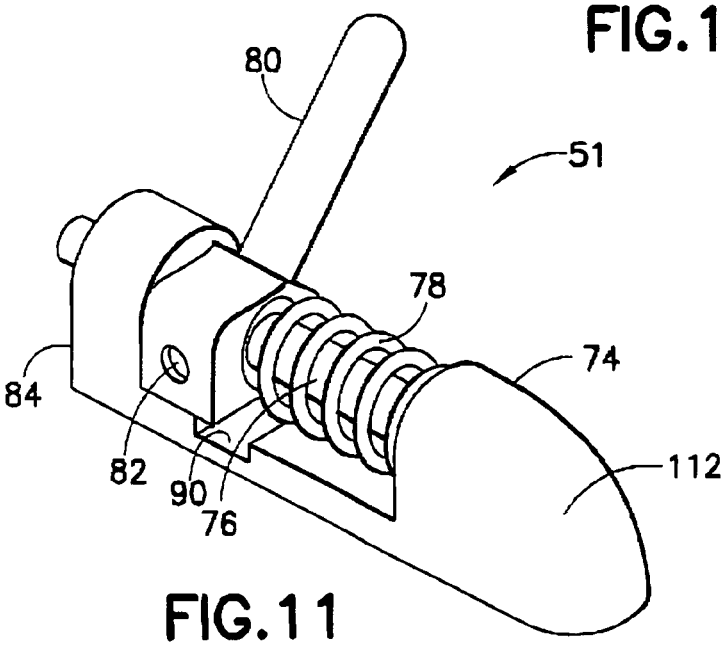
FIG. 11 is a perspective view of another one of the movable latches used to the connection system.

Referring now to FIGS. 10–13, the two movable latches 50, 51 are shown. FIG. 10 shows the movable latch 50 which is located on the port or left side of the mast 28 and FIG. 11 shows the movable latch 51 which is located on the starboard or right side of the mast 28. The two movable latches 50, 51 are substantially mirror images of each other. Thus, they will be described below with reference merely to the port side movable latch 50.

The latch 50 generally comprises a latch bracket 74, a latch plunger 76, a spring 78, and a latch handle 80. The only difference between the starboard side latch 51 and the port side latch 50 is that the handle 80 is located in a reverse position. Otherwise, the position and configuration of the other components 74, 76 and 78 are the same. The latch bracket 74 is stationarily attached to the top side of the frame 52 of the remote front end 24. The two latches 50, 51 are located relative to each other to receive the base section 60 of the aircraft mounting section 42 between the two latches, with the two latches being located in the two lateral cutouts 67 of the base section 60 when the base section is located at its deployed position.

The plunger 76 is slidably attached to the latch bracket 74. The handle 80 is stationarily attached to the latch plunger 76 by a fastener 82. The spring 78 biases the handle 80 towards the front end 84 of the latch bracket 74. Because the handle 80 is attached to the plunger 76, the spring 78 biases the plunger 76 in a forward direction; towards the front end of the aircraft. FIGS. 10–13 show the latches 50, 51 at a latching position. The front end 86 of the plunger extends past the front end 84 of the latch bracket 74 in the latching position. When the aircraft mounting section 42 of the mast 28 is located in its deployed position and the latches 50, 51 are located in their latched positions, the front ends 86 of the plungers 76 extend into the holes 66 of the latch receivers 64 to latch the mast 28 to the frame 52 of the remote front end 24.

The tapered shape of the front ends 86 and the holes 66 insure a tight fit of the plungers into the latch receivers. The shapes of the front end 86 and hole 66 preferably prevent the front tip of the front end from bottoming out in the hole 66. Constant axial force provided by the spring 78 keep the plunger and retainer engaged. This type of design provides a predictable load which will not back off in flight and keeps the latch in place during flight. The spring allows for manufacturing tolerances to be compensated for. The spring provides an active, adaptive load during flight. One of the features of the present invention is the fact that no special tools are needed to move the antenna assembly between its deployed and stowed positions. The latches are all hand operated. This allows for fast and easy assembly of the aircraft in the field, such as a battlefield, where speed may be essential. Compared to an assembly which would require the use of tools, set-up time with the tool-less system of the present invention is significantly reduced.

Figure 12:
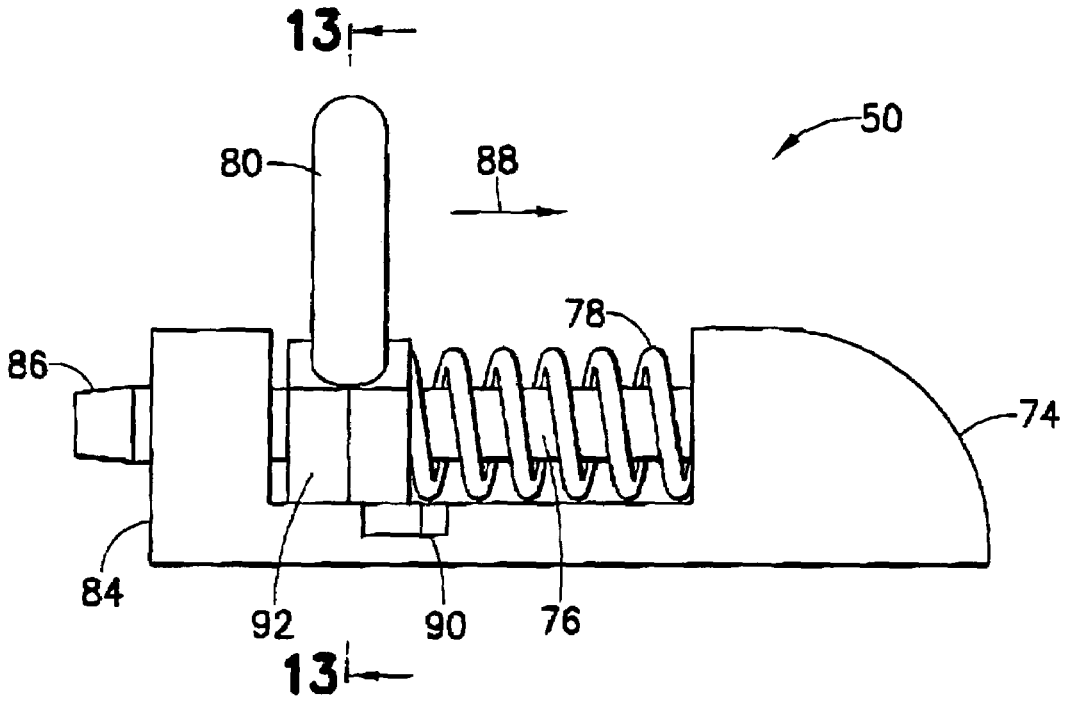
FIG. 12 is a side elevational view of the latch shown in FIG. 10.
Figure 13:
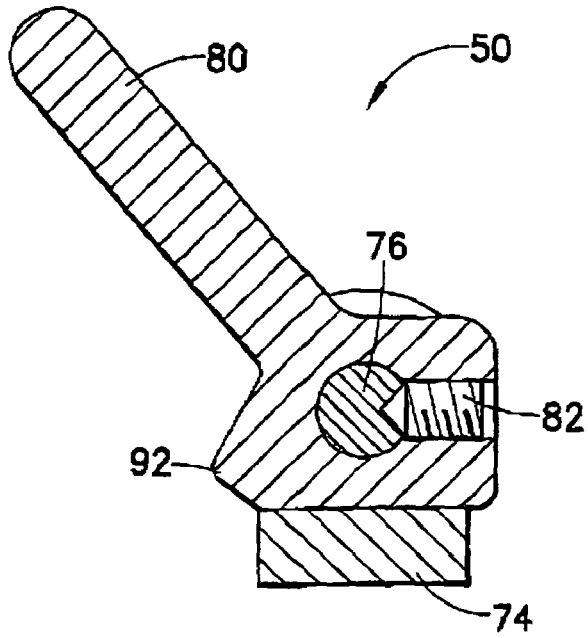
FIG. 13 is a cross sectional view of the latch shown in FIG. 12 taken along line 13—13.

In order to unlatch the aircraft mounting section 42 from the latches 50, 51, a user can move the handles 80 in a rearward or aft direction as indicated by arrow 88 in FIG. 12. This caused the handle 80 to compress the spring 78 moves the front end 86 of the plunger out of the hole 66 of the latch receiver 64. The latch bracket 74 includes a slot 90. The handle 80 includes an extension 92. When the handle 80 is moved to a retracted position by the user, the user can rotate the handle 80 to move the extension 92 into the slot 90. The user can then release the handle and interference provided between the slot 90 and the extension 92 can retain the handle and plunger in their retracted positions. In order to move the plunger back to its latching position, the user merely needs to rotate the handle 80 to move the extension 92 out of the slot 90 and the spring 78 can push the handle and plunger back to their latching positions. The spring 78 insures that the latches 50, 51 will remain at their latched positions during a flight of the aircraft, as well as at takeoff and landing.

Referring back to FIG. 5, the connection system comprises a third latch 108 connected to the air frame 12 in a position behind the remote front end 24. The third latch 108 is identical to the left side latch 50 shown in FIG. 10. However, the third latch 108 is located in a reversed direction relative to the latches 50, 51. More specifically, the latch plunger of the third latch 108 is biased by its spring in a rearward direction. The antenna mounting section 44 of the mast 28 has a latch section 110 (see FIG. 7). When the antenna assembly 18 is moved to its stowed position as shown in FIG. 5, the third latch 108 can be moved to a latched position to engage the latch section 110. This can stationarily latch the antenna assembly 18 at its stowed position. The latch 108 and latch section 110 are configured such that the radome 34 does not contact the aircraft frame when the antenna assembly is moved to its stowed position. This prevents damage to the radome while the antenna assembly is in its stowed position. In the stowed position, the main section of the mast is located substantially parallel to the top surface of the aircraft body. The antenna assembly is preferably constructed such that during level flight the antenna is substantially parallel to the surface of the earth; such as a six degree downward angle 200 on the top of the mast as seen in FIG. 4.

The end 112 of the latch bracket 74 has a curved aerodynamic shape along its front, top side. Thus, for the third latch 108 the end 112 can form an aerodynamically shaped front end for the latch. The front, a top side of the latch receivers 64 are also aerodynamically shaped with a curved front, top end. Thus, the latch receivers 64 can provide an aerodynamically shaped lead section for the latches 50, 51 and, the end 112 can form an aerodynamically shaped lead section for the latch 108.

The advantages of the present invention over past practices are to allow an aircraft antenna and mast to be folded allowing storage of the aircraft in a smaller volume. Another the advantage is having a weak mechanical structure to the mast so that it breaks off in the event of an impact preventing more expensive components of the aircraft from sustaining damage. The invention also has a feature for rigidly attaching the mast in a deployed (vertical) position and also a latch for its stowed (horizontal) position. Another feature of the present invention is that the system can be deployed or retracted without the use of tools (i.e., a tool-less deployable antenna system). Another feature of the invention is that the pivot height is determined so that the cylindrical shape of the antenna radome does not contact the aircraft exterior when it is folded down. Another feature of the invention is that the pivot slot opening in the mast, which fits around the base piece of the pivot, allows the stiff antenna cable to pass through; consequently providing a larger bend radius for the cable and reducing the overall length of the cable (overall cable length is kept as short as possible to reduce the signal loss). This foldable antenna mast does not require the RF cable to be removed and reconnected each time the aircraft is deployed; which reduces losses within the RF connection.

One of the features of the present invention is the ability to locate the antenna at a raised position away from the rest of the aircraft during flight, but provide a smaller profile for storage and transportation. By locating the antenna away from the rest of the aircraft during flight, this avoids shadowing or signal disruption with the remote control area on the ground, sea or air. This can be particularly important for certain radio frequencies, such as in a KU band of radio signal transmission.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. An aircraft radio antenna assembly comprising:

a mast;

an omni-directional antenna connected to a first end of the mast; and a pivot and movable latch connection system at a second end of the mast, wherein, when the pivot and latch connection system is attached to an aircraft, the mast is located at a stowed position or pivoted up to a deployed position and latched into the deployed position.

2. An aircraft radio antenna assembly as in claim 1 wherein the mast comprises an aerodynamic main section, an aircraft mounting section forming part of the pivot and movable latch connection system, and a breakaway connection between the main section and the aircraft mounting section.

3. An aircraft radio antenna assembly as in claim 1 wherein the pivot and movable latch connection system comprises the mast having an aircraft mounting section with a base section having a pivot section at a rear end of the base section, and a mast pivot bracket pivotably connected to the pivot section and adapted to be stationarily connected to the aircraft.

4. An aircraft radio antenna assembly as in claim 3 wherein the aircraft mounting section further comprises a latch receiver at a front end of the base section, and the pivot and movable latch connection system further comprises a movable latch located at a lateral side of the mast adapted to latch with the latch receiver.

5. An aircraft radio antenna assembly as in claim 4 wherein the aircraft mounting section comprises two of the latch receivers and the pivot and movable latch connection system comprises two of the movable latches, the latches being located on opposite lateral sides of the mast.

6. An aircraft radio antenna assembly as in claim 4 wherein the latch comprises a latch plunger and a spring biasing the latch plunger in a forward direction towards the latch receiver.

7. An aircraft radio antenna assembly as in claim 6 wherein the latch further comprises a handle fixedly connected to the latch plunger and a latch bracket having the latch plunger and spring connected thereto, wherein the handle is adapted to be moved by a user to move the latch plunger to an unlatched position, and wherein the handle is adapted to engage the latch bracket and retain the latch plunger at the unlatched position.

8. An aircraft radio antenna assembly as in claim 6 wherein a front end of the latch plunger comprises a tapered shape and the latch receiver comprises a tapered hole for receiving the front end of the latch plunger.

9. An aircraft radio antenna assembly as in claim 8 wherein the latch receiver comprises a curved aerodynamic front end.

10. An aircraft radio antenna assembly as in claim 3 wherein the mast pivot bracket comprises forward facing wedge surfaces and a mast base comprises rearward facing tapered surfaces which engage the wedge surfaces when the mast is located at the deployed position to wedge the base mast in a downward direction towards the aircraft.

11. An aircraft radio antenna assembly as in claim 3 wherein a pivotal connection between the mast and the mast pivot bracket is located at an extended distance from the mast base such that the mast base is located at an elevated position relative to the aircraft when the mast is located at its stowed position.

12. An aircraft radio antenna assembly as in claim 3 further comprising a boot connected to a hole in the mast base, the boot being adapted to be connected to the aircraft and provide a sealed collapsible path for an antenna cable to extend through the boot between the aircraft and the mast.

13. An aircraft radio antenna assembly as in claim 1 wherein the pivot and movable latch connection system comprises a first latch for latching the mast in the stowed position and at least one second latch located at a lateral side of the mast for latching the mast in the deployed position.

14. An aircraft radio antenna assembly as in claim 13 wherein the first latch comprises a latch plunger biased in a rearward direction and the at least one second latch comprises a latch plunger biased in a forward direction.

15. An aircraft radio antenna assembly comprising:

an antenna; and a mast having the antenna connected to a first end of the mast, the mast comprising an aircraft mounting section located at a second end of the mast, a main section extending from the aircraft mounting section to the first end of the mast, and a breakaway connection between the main section and the aircraft mounting section.

16. An aircraft radio antenna assembly as in claim 15 wherein the breakaway connection comprises fasteners connecting the main section to the aircraft mounting section, wherein the fasteners are comprised of material which is weaker than material forming the main section and the aircraft mounting section.

17. An aircraft radio antenna assembly as in claim 16 wherein the fasteners comprise rivets.

18. An aircraft radio antenna assembly as in claim 15 further comprising a pivot and movable latch connection system adapted to connect the mast to an aircraft, the connection system comprising the aircraft mounting section being pivotably mounted to a mast pivot bracket adapted to be fixedly connected to the aircraft, and at least one latch adapted to be fixedly connected to the aircraft for latching the aircraft mounting section in a deployed position relative to the aircraft.

19. An aircraft radio antenna assembly as in claim 18 wherein the aircraft mounting section comprises a base section having a pivot section at a rear end of the base section which is pivotably connected to the mast pivot bracket, wherein the pivot section has a pivot axis located at an extended distance away from a top side of the base section.

20. An aircraft radio antenna assembly as in claim 19 wherein the aircraft mounting section further comprises a latch receiver at a front end of the base section, and the at least one latch is located on the aircraft at a lateral side of the mast and adapted to latch with the latch receiver.

21. An aircraft radio antenna assembly as in claim 20 wherein the aircraft mounting section comprises two of the latch receivers and the pivot and movable latch connection system comprises two of the latches, the latches being located on opposite lateral sides of the mast.

22. An aircraft radio antenna assembly as in claim 20 wherein the latch comprises a latch plunger and a spring biasing the latch plunger in a forward direction towards the latch receiver.

23. An aircraft radio antenna assembly as in claim 22 wherein the latch further comprises a handle fixedly connected to the latch plunger and a latch bracket having the latch plunger and spring connected thereto, wherein the handle is adapted to be moved by a user to move the latch plunger to an unlatched position, and wherein the handle is adapted to engage the latch bracket and retain the latch plunger at the unlatched position.

24. An aircraft radio antenna assembly as in claim 23 wherein a front end of the latch plunger comprises a tapered shape and the latch receiver comprises a tapered hole for receiving the front end of the latch plunger.

25. An aircraft radio antenna assembly as in claim 20 wherein the latch receiver comprises a curved aerodynamic front end.

26. An aircraft radio antenna assembly as in claim 18 wherein the mast pivot bracket comprises forward facing wedge surfaces and the mast base comprises rearward facing tapered surfaces which engage the wedge surfaces when the mast is located at the deployed position to wedge the base mast in a downward direction towards the aircraft.

27. An aircraft radio antenna assembly as in claim 18 wherein a pivotal connection between the mast and the mast pivot bracket is located at an extended distance from the mast base such that the mast base is located at an elevated position relative to an aircraft when the mast is located at its stowed position.

28. An aircraft radio antenna assembly as in claim 15 further comprising a boot connected to a hole in the aircraft mounting section, the boot being adapted to be connected to the aircraft and provide a sealed path for an antenna cable to extend through the boot between the aircraft and the mast.

29. An aircraft radio antenna assembly as in claim 15 wherein the pivot and movable latch connection system comprises a first latch for latching the mast in a stowed position and at least one second latch connected to the aircraft which is located at a lateral side of the mast for latching the mast in a deployed position.

30. An aircraft radio antenna assembly as in claim 29 wherein the first latch comprises a latch plunger biased in a rearward direction and the at least one second latch comprises a latch plunger biased in a forward direction.

31. An aircraft antenna mast connection system comprising:

a mast pivot bracket connected to an aircraft, the mast pivot bracket comprising a base section attached to the aircraft and a pivot section forming a pivot axis at an extended distance from the base section; and a mast base pivotably connected to the mast pivot bracket at the extended distance from the base section, the mast base having a hole with an antenna cable passing from the aircraft and through the hole, wherein rotation of the mast base from a deployed position with the mast base being against the aircraft to a stowed position with the mast base being spaced from the aircraft provides an enlarged radius of curvature for the antenna cable provided by the pivot axis being located at the extended distance from the base section.

32. An aircraft antenna mast connection system as in claim 31 wherein the extended distance is about 0.75 in.

33. An aircraft antenna mast connection system as in claim 31 wherein the mast pivot bracket comprises rearward and downward beveled surfaces at a front side of the base section on opposite sides of the pivot section which are adapted to be contacted by mating surfaces on a rear end of the mast base to wedge the rear end of the mast base towards the aircraft in the deployed position.

34. An aircraft antenna mast connection system as in claim 31 further comprising a resilient collapsible boot connected between the mast base at the hole and the aircraft, wherein the antenna cable passes through the resilient boot from the aircraft and through the hole.

35. An aircraft antenna mast connection system as in claim 31 further comprising a movable latch connected to the aircraft and a latch receiver connected to the mast base, wherein the movable latch is located at a lateral side of the mast base when the mast base is in the deployed position and comprises a latch plunger movable in a forward direction to latch with the latch receiver.

36. An aircraft antenna mast connection system as in claim 35 wherein the latch receiver comprises a front side with a curved aerodynamic shape and a rear side with a hole for receiving a front end of the latch plunger.

37. An aircraft antenna mast connection system as in claim 35 further comprising a second movable latch located on an opposite lateral side of the mast base.

38. An aircraft antenna mast connection system as in claim 35 wherein the latch comprises a spring biasing the latch plunger in a forward direction towards the latch receiver, and wherein the latch further comprises a handle fixedly connected to the latch plunger and a latch bracket attached to the aircraft having the latch plunger and spring connected thereto, wherein the handle is adapted to be moved by a user to move the latch plunger to an unlatched position, and wherein the handle is adapted to engage the latch bracket and retain the latch plunger in the unlatched position.

39. An aircraft antenna mast connection system comprising:

a mast pivot bracket connected to an aircraft;

an aircraft mounting section of an antenna mast, the aircraft mounting section comprising a mast base and at least one latch receiver, wherein the mast base is pivotably connected to the mast pivot bracket at a first end of the mast base and the at least one latch receiver is attached to an opposite second end of the mast base; and at least one movable latch attached to the aircraft, the latch comprising a spring loaded plunger adapted to latch with the at least one latch receiver when the antenna mast is moved to a deployed position.

40. An aircraft antenna mast connection system as in claim 39 wherein the second end is a front end of the mast base and the at least one latch receiver comprises a plunger receiving hole extending into a rear side of the latch receiver.

41. An aircraft antenna mast connection system as in claim 39 wherein the second end is a front end of the mast base, and wherein the at least one latch receiver comprises two latch receivers located on opposite lateral sides of the mast base at the front end.

42. An aircraft antenna mast connection system as in claim 39 wherein the at least one movable latch is located along a lateral side of the mast base when the mast base is located at the deployed position.

43. An aircraft antenna mast connection system as in claim 39 wherein the at least one movable latch comprises two movable latches located on opposite lateral sides of the mast base.

44. An aircraft antenna mast connection system as in claim 39 wherein the mast pivot bracket comprises a base section attached to the aircraft and a pivot section forming a pivot axis at an extended distance from the base section, wherein the mast base is pivotably connected to the pivot section at the pivot axis.

45. An aircraft antenna mast connection system as in claim 44 wherein the base section of the mast pivot bracket comprises rearward and downward beveled surfaces at a front side of the base section on opposite sides of the pivot section which are adapted to be contacted by mating surfaces on a rear end of the mast base to wedge the rear end of the mast base towards the aircraft in the deployed position.

46. An aircraft antenna mast connection system as in claim 39 further comprising a resilient boot connected between the mast base and the aircraft, the boot providing a collapsible sealed conduit for an antenna cable to extend between the aircraft and the antenna mast.

47. A method of positioning an aircraft antenna mast at a deployed position comprising steps of:

pivoting the aircraft antenna mast on a mast pivot bracket at a rear side of the mast from a stowed position to the deployed position; and moving a latch on the aircraft from an unlatched position to a latched position, wherein the latch is located along a lateral side of the mast and the latch has a latching plunger which moves forward when the latch is moved to the latched position to engage a latch receiver on a front side of the mast.

* * * * *